US008464705B2

(12) United States Patent
Kitayama et al.

(10) Patent No.: US 8,464,705 B2
(45) Date of Patent: Jun. 18, 2013

(54) COOKING DEVICE

(75) Inventors: Hiroki Kitayama, Osaka (JP); Masahiro Nishijima, Gose (JP); Takeyuki Ozaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 564 days.

(21) Appl. No.: 12/376,262

(22) PCT Filed: Jul. 9, 2007

(86) PCT No.: PCT/JP2007/063636

§ 371 (c)(1),
(2), (4) Date: Feb. 3, 2009

(87) PCT Pub. No.: WO2008/015875

PCT Pub. Date: Feb. 7, 2008

(65) Prior Publication Data

US 2010/0006084 A1 Jan. 14, 2010

(30) Foreign Application Priority Data

Aug. 4, 2006 (JP) ..... 2006-213624

(51) Int. Cl.
*F24C 15/02* (2006.01)

(52) U.S. Cl.
USPC ..... 126/190; 126/194

(58) Field of Classification Search
USPC ..... 126/190, 191, 192, 194, 197
See application file for complete search history.

(56) References Cited

U.S. PATENT DOCUMENTS

| | | | | | |
|---|---|---|---|---|---|
| 1,640,250 | A | * | 8/1927 | Possons | 126/190 |
| 2,378,421 | A | * | 6/1945 | McCormick | 126/190 |
| 2,776,655 | A | * | 1/1957 | Ferguson, Jr. et al. | 126/194 |
| 3,040,731 | A | * | 6/1962 | Mudd | 126/191 |
| 3,150,659 | A | * | 9/1964 | Ellis et al. | 126/194 |
| 3,155,088 | A | * | 11/1964 | Barber | 126/191 |
| 3,304,932 | A | * | 2/1967 | Gilliom | 126/194 |
| 3,398,735 | A | * | 8/1968 | Barber | 126/191 |
| 3,453,996 | A | * | 7/1969 | Agee | 126/191 |
| 3,503,380 | A | * | 3/1970 | Vasaturo | 126/191 |

(Continued)

FOREIGN PATENT DOCUMENTS

| | | |
|---|---|---|
| JP | 46-9082 U | 3/1971 |
| JP | 47-860 Y | 1/1972 |

(Continued)

*Primary Examiner* — Alfred Basichas
(74) *Attorney, Agent, or Firm* — Birch, Stewart, Kolasch & Birch, LLP

(57) ABSTRACT

An open/close adjustment device is connected to the door of a heating chamber of a cooking device, and the open/close adjustment device pulls the door back to its totally closed position. The open/close adjustment device adjusts an operation force when the door is passing a predetermined open angle. The operation force indicates a maximum value when the door is passing the predetermined open angle, and the maximum value is given by two protrusions disposed at front-side and rear-side with distance between them. Each of the protrusions each produces a load when they go over a support member, and a following one of the two protrusions produces a load larger than a load firstly produced by a preceding one of the two protrusions when the door is opened.

5 Claims, 8 Drawing Sheets

U.S. PATENT DOCUMENTS

| | | | | | |
|---|---|---|---|---|---|
| 3,842,542 | A | * | 10/1974 | White et al. | 49/386 |
| 4,138,988 | A | * | 2/1979 | Hurley | 126/194 |
| 4,287,873 | A | * | 9/1981 | Goins et al. | 126/194 |
| 4,315,495 | A | * | 2/1982 | Jellies | 126/194 |
| 4,374,320 | A | * | 2/1983 | Barnett | 219/413 |
| 4,817,240 | A | * | 4/1989 | Sovis et al. | 16/297 |
| 5,220,747 | A | * | 6/1993 | Cherry et al. | 49/386 |
| 5,341,542 | A | * | 8/1994 | Hannan et al. | 16/289 |
| 6,539,581 | B1 | * | 4/2003 | Faringosi | 16/327 |

FOREIGN PATENT DOCUMENTS

| | | | |
|---|---|---|---|
| JP | 50-27067 | U | 3/1975 |
| JP | 51-21670 | U | 2/1976 |
| JP | 53-120264 | U | 9/1978 |
| JP | 2002-39541 | A | 2/2002 |
| JP | 2005-344967 | A | 12/2005 |
| JP | 2006-2961 | A | 1/2006 |
| JP | 4111979 | B2 | 4/2008 |

* cited by examiner

COOKING DEVICE

TECHNICAL FIELD

The present invention relates to an oven type cooking device that uses a heating medium such as superheated steam, hot air, and the like, to cook a food.

BACKGROUND ART

An oven type cooking device that cooks a food placed in a heating chamber with a heating medium is becoming common among Japanese households. In such a cooking device, usually, a door that is opened and closed in a vertical plane about a lower edge thereof is disposed at a front of its heating chamber. The door is often equipped with a mechanism which is capable of keeping a half-open position of the door. Examples of such cooking devices with a door that is able to be in a half-open state are disclosed in patent documents 1 to 5.

The patent document 1 discloses a gas cooking device in which a recess is formed on a suitable position of an arc-shaped arm that protrudes from a back side of a door, and a roller supported at a free end of a leaf spring engages with the recess, thereby the door is held at a half-open position. The patent document 2 discloses a gas oven in which a recess is formed on an edge of an arc-shaped support arm that is fixed to a door, and a rotor such as a roller or a ball is pressed against the recess by a spring, thereby the door is held at a half-open position. The patent document 3 discloses a gas oven in which a recess for full-open lock and a recess for half-open lock are formed on a tension rod that transmits force of a coil spring to the door, and the recess for half-open lock engages with a detent roller, thereby the door is held at a half-open position. The patent document 4 discloses a duplex roasting device in which a roller fits into one of recesses formed in an arm that is fixed to a door so that an open angle of the door is limited. The patent document 5 discloses a gas oven in which a roller fits into a recess in an arc-shaped arm one end of which is fixed to a door so that the door is stopped at the position.

[Patent document 1]: JP-U-1978-120264
[Patent document 2]: JP-U-1971-9082B
[Patent document 3]: JP-U-1976-21670
[Patent document 1]: JP-U-1975-27067
[Patent document 2]: JP-U-1972-860B

DISCLOSURE OF THE INVENTION

Problems to be Solved by the Invention

In the cooking devices disclosed in the above patent documents, whenever a door is opened or closed, engagement to hold the door at a half-open position takes place. One of the purposes for keeping the door of a cooking device at the half-open position is that "a heating medium in a heating chamber is guided to flow upward to prevent it from flowing to the user, and the door can be fully opened after pressure of the heating medium in the heating chamber becomes low." For this purpose, it is advantageous to users that relatively large operation force is temporarily needed when the door is opened, and the half-open state of the door is inevitable, whereas relatively small operation force is needed for smooth closing of the door. It is an object of the present invention to provide a cooking device in which a door is moved in above-mentioned manner.

Means for Solving the Problem

To achieve the object, a cooking device according to the present invention in which a food is heated in a heating chamber with a heating medium, an opening of a heating chamber is closed with a door which swings around a horizontal pivot shaft disposed at a lower portion of a cabinet, the cooking device is characterized in that an open/close adjustment device which connects the cabinet and the door with each other and adjusts an operation force needed to open or to close the door, the operation force indicates a maximum value when the door is passing a predetermined open angle, the maximum value is given by two protrusions disposed at front-side and rear-side with a distance between them, the protrusions each produce a load when they go over a support member, and a following one of the two protrusions produces a load larger than a load firstly produced by a preceding one of the two protrusions when the door is opened.

According to this structure, when the door is opened, the preceding protrusion first produces a load, and after the load is over, the following protrusion produces a larger load. Consequently, another operation force is needed to fulfill either opening or returning of the door. Thus, it is possible to keep the door at a half-open state with the support member held between the preceding protrusion and the following protrusion.

The cooking device according to the present invention having the above structure is characterized in that the open/close adjustment device exerts on the door a bias urging it toward the totally closed position.

According to this structure, operation of closing the door is assisted by the open/close adjustment device, thereby the user can easily close the door.

The cooking device according to the present invention having the above structure is characterized in that the open/close adjustment device includes: a link one end of which is connected to the door at a position higher than the open/close fulcrum of the door, and the other end of which is a free end; a support member which supports the link from beneath at a fixed position; a spring which is disposed between the link and a fixed member and exerts on the link a force that presses the link against the pulley and a force that causes the link to pull the door back to the totally closed position; and the protrusions are formed on a lower surface of the link.

According to this structure, the open/close adjustment device that achieves the desired object can be formed by a combination of simple mechanical components.

The cooking device according to the present invention having the above structure is characterized in that the spring is a single tension coil spring that is mounted across the free end of the link and the fixed member.

According to this structure, because the single tension coil spring serves as both a spring to achieve the half-open state of the door and a spring to pull the door back to the totally closed position, it is possible to reduce the number of components and cost. Besides, the tension coil spring is easy to mount.

The cooking device according to the resent invention having the above structure is characterized in that the support member is a wheel-shaped rotor.

According to this structure, due to the rotation of the rotor, the movement of the link faces relatively small resistance, thereby, the user gets a smooth feel when opening or closing the door. Furthermore, the link and the support member come not into sliding contact but into rolling contact with each other, the contact portions are not easily worn, and replacement of the components is unnecessary for a long period.

The cooking device according to the present invention having the above structure is characterized in that the spring is a single tension coil spring that is mounted across the free end of the link and a fixed member.

According to this structure, because the single tension coil spring serves as both a spring to achieve the half-open state of the door and a spring to pull the door back to the totally closed position, it is possible to reduce the number of components and cost. Besides, the tension coil spring is easy to mount.

The cooking device according to the present invention having the above structure is characterized in that the link has two protrusions formed thereon, one at front-side and one at rear-side, and the protrusion following the other when the door is opened produces a load larger than a load firstly produced by the preceding protrusion.

According to this structure, when opening the door, because after the door goes over a load produced by the preceding protrusion, the following protrusion produces a load larger than the load produced by the preceding protrusion. Consequently, another operation force is needed to fulfill either opening or returning of the door. Thus, it is possible to keep the door at a half-open state with the support member held between the preceding protrusion and the following protrusion.

The cooking device according to the present invention having the above structure is characterized in that the support member is a wheel-shaped rotor.

According to this structure, because the rotor rotates to allow movement of the link under low resistance, the operation of opening and closing the door becomes comfortable. Besides, the link and the support member come not into sliding contact but into rolling contact with each other, therefore, the contact portions are not easily worn, and replacement of the components is unnecessary for a long period.

Advantages of the Invention

According to the present invention, the open/close adjustment device which connects the cabinet and the door with each other and adjusts an operation force needed to open or to close the door, the operation force indicates a maximum value when the door is passing a predetermined open angle, the maximum value is given by two protrusions disposed at front-side and rear-side with a distance between them, each of the protrusions produces a load when they go over a support member, and a following one of the two protrusions produces a load larger than a load firstly produced by a preceding one of the two protrusions when the door is opened, thereby it is possible to keep the door at a half-open position to let the heating medium in the heating chamber escape upward so that the heating medium does not flow to the user.

LIST OF REFERENCE SYMBOLS

Figure 1:
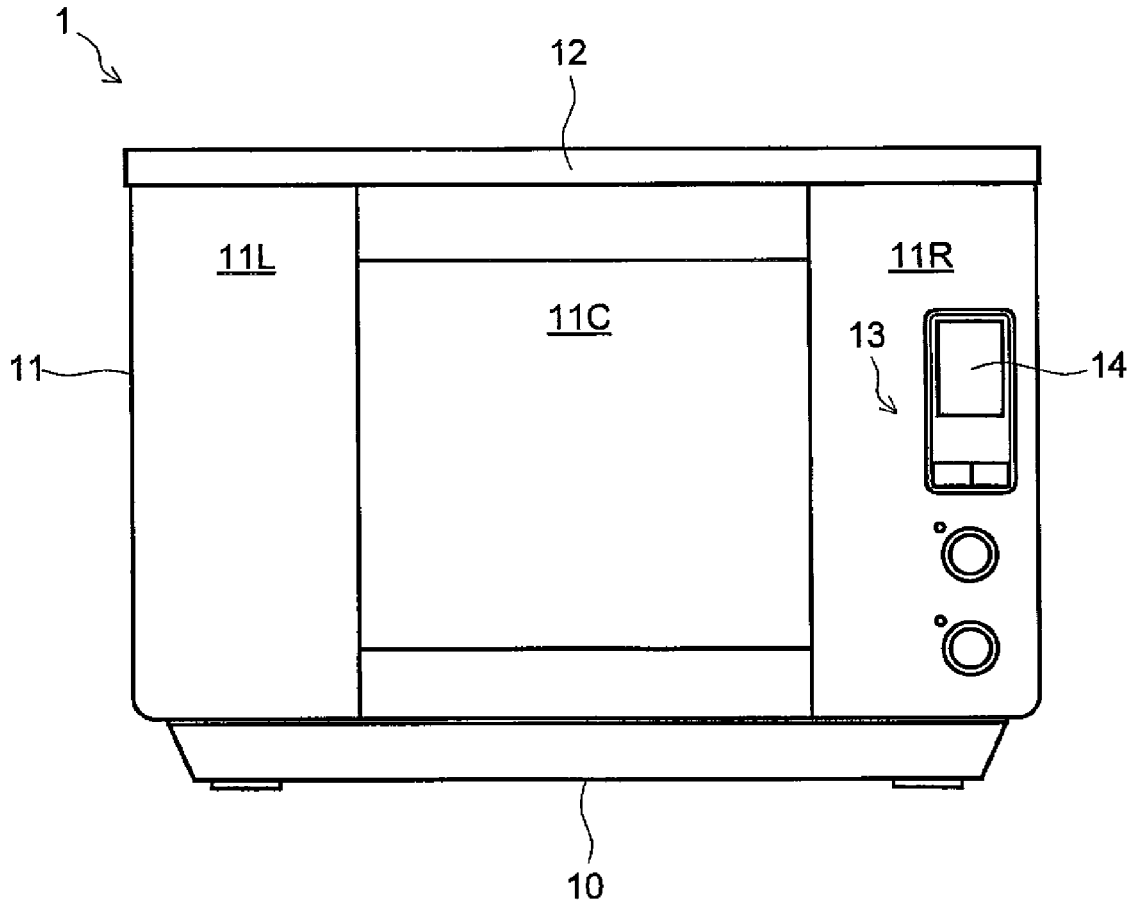
FIG. 1 is a front view of a cooking device according to one embodiment of the present invention.

1 cooking device
11 door
12 handle
20 heating chamber
40 heating-medium generation apparatus
43 upper heating-medium supply opening
47 side heating-medium supply opening
60 steam generation apparatus
100 food tray
110 food grill
F food
120 open/close adjustment device
121 base
122 pivot shaft
123 link
124 support shaft
126 pulley (support member)
127 tension coil spring
128, 129 protrusions

BEST MODE FOR CARRYING OUT THE INVENTION

An embodiment of a cooking device according to the present invention will be explained according to FIG. 1 to FIG. 5. A cooking device 1 has a cabinet 10 shaped rectangular parallelepiped. At a front of the cabinet 10, a door 11 is disposed to close an opening of a heating chamber 20. The door 11 swings around a horizontal pivot shaft 122 (see FIG. 6) disposed along a lower edge of the door 11. The door 11 is moved 90° from a vertical totally closed position shown in FIG. 1 to a horizontal fully opened state shown in FIG. 2 when a handle 12 disposed on an upper portion of the door 11 is gripped and pulled toward a user. An open/close adjustment device is connected to the door 11 to pull the door 11 back to the totally closed position, the detail of which will be described later.

The door 11 has a center portion 11C having a transparent section into which a heat-resistant glass plate is fitted, and a left-side portion 11L and a right-side portion flanking the center portion 11C. Each of the left-side portion 11L and the right-side portion 11R is ornamented with metal sheet. An operation console 13 is disposed on the right-side portion 11R.

The heating chamber 20 is rectangular parallelepiped in shape and its front side facing the door 11 is an opening as a whole. The remaining sides of the heating chamber 20 are made of steel plate. The sides of the heating chamber 20 are thermally insulated.

The cooking device 1 can heat food with not only a heating medium but also a microwave. Now, a heating system of the cooking device will be explained with reference to chiefly FIG. 4.

A microwave generation apparatus 21 is built in a portion under a floor of the heating chamber 20. Specifically, the floor of the heating chamber 20 is formed of a material such as glass, ceramic and the like that transmit a microwave. An antenna room 22 is formed under the floor. The antenna room 22 houses an antenna 23. The antenna 23 is swung in a horizontal plane by an antenna motor 24. A microwave generated by a magnetron 25 is introduced into the antenna room 22 via a wave guide 26, and the introduced microwave is supplied into the heating chamber 20 by the antenna 23. The magnetron 25 oscillates on power from a microwave power supply 27 (see FIG. 5).

Under the floor of the heating chamber 20, a lower heater 28 is disposed besides the microwave generation apparatus 21. The lower heater 28 cooperates with a heating-medium heater 42, which will be described later, to heat a heating medium in the heating chamber 20 to a predetermined temperature.

The cooking device 1 uses superheated steam or hot air as a heating medium. The heating medium circulates via an external circulation path 30. The external circulation path 30 starts at an inlet 31 formed at an upper portion of a side wall of the inner part of the heating chamber 20. The inlet 31 consists of a collection of small apertures.

A blower 32 follows the inlet 31. The blower 32 is disposed on an outer surface of the side wall of the inner part of the heating chamber 20. The blower 32 includes a centrifugal fan 33, a fan casing 34 that houses the centrifugal fan 33, and a fan motor 35 (see FIG. 5) that rotates the centrifugal fan 33. A sirocco fan is used as the centrifugal fan 33. A DC motor, which is capable of rotating at a high speed, is used as the fan motor 35.

The heating medium sent out of the fan casing 34 is introduced into the heating-medium generation apparatus 40 via a duct 36. The heating-medium generation apparatus 40 is composed of a heating-medium heater 42 arranged in a heat-up room 41 formed on a roof of the heating chamber 20, and is disposed in a center of the roof when seen in a plane. The heating-medium heater 42 is composed of a sheathed heater.

The heating medium, the temperature of which has been raised by the heating-medium generation apparatus 40, is supplied into the heating chamber 20 as jets from the upper portion and side portions of the heating chamber 20. A mechanism of producing the jets is explained below.

An upper heating-medium supply opening 43 is formed at an upper portion of the heating chamber 20. The upper heating-medium supply opening 43 is composed of a jet cowl 44 that serves as a floor of the heat-up room 41 and as a portion of the ceiling of the heating chamber 20. The jet cowl 44 has a shape in vertical section that is obtained by placing a trapezoidal dome up side down. A plurality of jet holes formed through the jet cowl 44 composes a jet producing portion. A plurality of vertical jet holes 45 through which the heating medium passes right under the jet cowl 44 are formed in a horizontal portion of the jet cowl 44. The horizontal portion occupies a large area in the center portion of the jet cowl 44. A plurality of oblique jet holes 46 through which the heating medium obliquely passes are formed in a slant portion surrounding the horizontal portion.

Outside both right-side and left-side walls of the heating chamber 20, side heating-medium supply gates 47 (see FIG. 3) are symmetrically formed. The heating medium is sent into both side heating-medium supply gates 47 via ducts 48 from the heating-medium generation apparatus 40. One side of the side heating-medium supply gate 47 facing the heating chamber 20 has an opening through which the heating medium comes out as a jet. In other words, the opening serves as a jet producing portion. A bottom portion of the side heating-medium supply gate 47 serves as a guide for directing the jet.

To generate saturated steam, which is a material for superheated steam serving as the heating medium, the cooking device 1 has a steam generation apparatus 60. The steam generation apparatus 60 includes a cylindrical pot 61 disposed with its center line being vertical.

Figure 4:
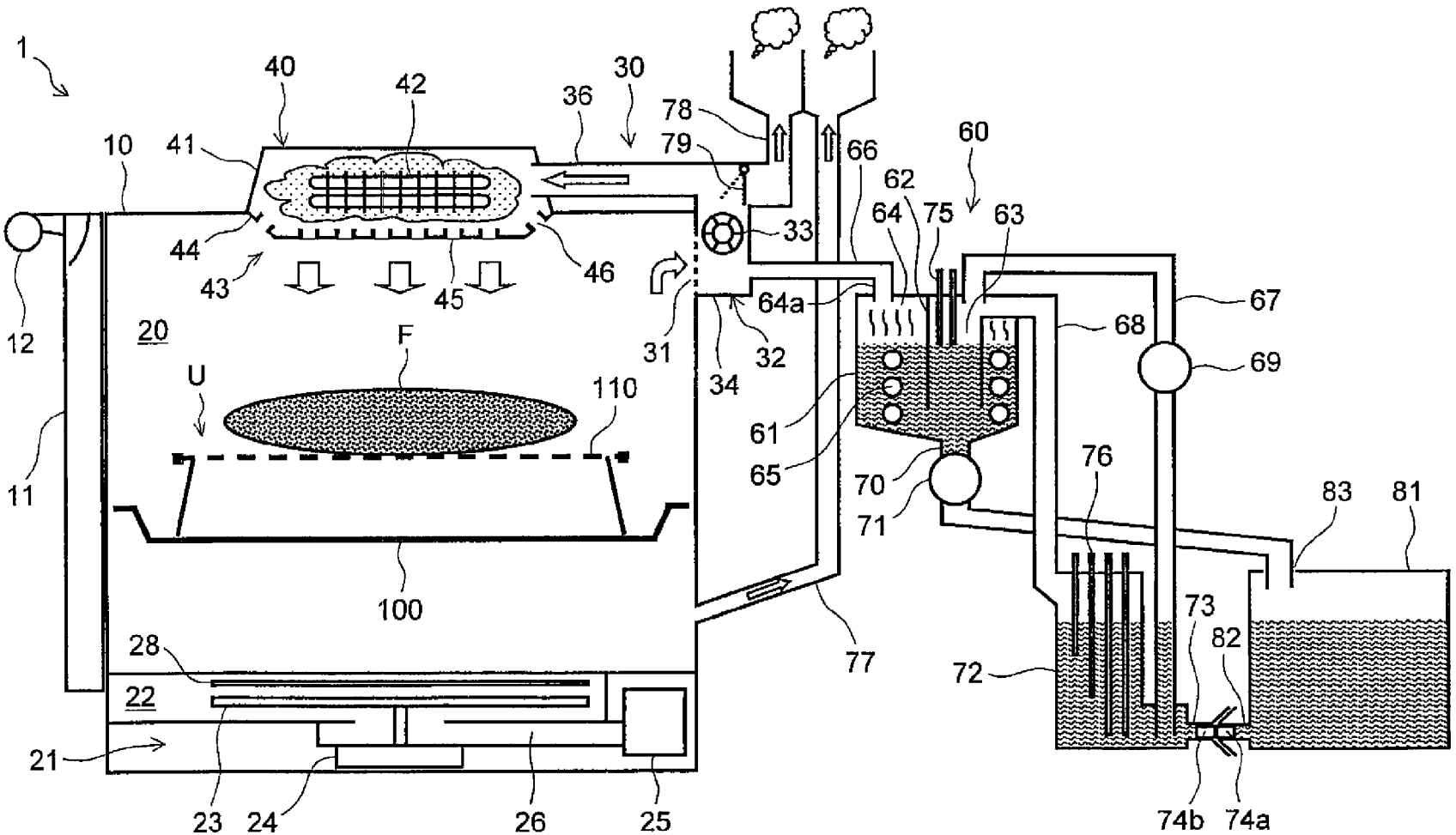
FIG. 4 is a view to explain the entire structure of a cooking device according to one embodiment of the present invention.

The inside of the pot 61 is concentrically divided by a cylindrical dividing wall 62 into outer and inner sections. The inner section is a water level detection room 63, and the outer section is a steam generation room 64. The dividing wall 62 is dangling above a bottom portion of the pot 61, and the water level detection room 63 and the steam generation room 64 communicate with each other in water. An upper space of the water level detection room 63 is opened to the atmosphere. A steam generation heater 65, a sheathed heater wound into a coil shape, is disposed in the steam generation room 64. A steam guide pipe 64*a* that leads to a steam supply pipe 66 is disposed through an upper portion of the steam generation apparatus 64. In FIG. 4, the steam guide pipe 64*a* is disposed through a portion of the ceiling of the pot 61. However, the steam guide pipe 64*a* may be disposed through a side wall of the pot 61.

An outlet portion of the steam supply pipe 66 is connected to the inlet side of the fan casing 34. The steam supply pipe 66 is formed of a flexible tube such as a rubber tube, a silicone tube and the like. If the steam guide pipe 64*a* is unitarily formed with the pot 61, the steam guide pipe 64*a* is inserted into the steam supply pipe 66 to connect with each other.

A water feed pipe 67 and an overflow pipe 68 are connected to an upper space of the water level detection room 63. The water feed pipe 67 pours water held in a water tank 81 housed in a water tank housing 80 (see FIG. 2) into the pot 61, and a water feed pump 69 is disposed in a halfway position of the water feed pipe 67. The bottom portion of the pot 61 is formed into a funnel shape, and a drainage pipe 70 extends from the funnel-shaped portion. A drainage valve 71 is disposed in a halfway position of the drainage pipe 70.

The water feed pump 69 does not directly suck up water from the water tank 81. It sucks up water from a relay tank 72 to which the water tank SI is connected. An outlet pipe 82 protrudes from a bottom portion of the water tank 81 toward the inner part of the water tank housing 80. The outlet pipe 82 connects with an inlet pipe 73 that protrudes sideward from the relay tank 72.

If the water tank 81 is pulled out from the water tank housing 80 and the outlet pipe 82 is disconnected from the inlet pipe 73, the water in the water tank 81 and the water in the relay tank 72 will leak out, provided that no action is taken. To prevent the leakage, coupling plugs 74*a* and 74*b* are mounted on the outlet pipe 82 and the inlet pipe 73, respectively. As shown in FIG. 4, in a state in which the outlet pipe 82 is connected to the inlet pipe 73, the coupling plugs 74*a* and 74*b* connect with each other so that water can flow. If the outlet pipe 82 is disconnected from the inlet pipe 72, the coupling plugs 74*a* and 74*b* are closed, and water leakage from the water tank 81 and the relay tank 72 is stopped.

The water feed pipe 67 is inserted into the relay tank 72 through the tank's ceiling, and its tip end extends near the bottom portion of the relay tank 72. The overflow pipe 68 is connected to the upper space of the relay tank 72. The upper space of the relay tank 72 is opened to the atmosphere via a pressure release opening (not shown), thereby the upper space of the water level detection room 63 also is opened to the atmosphere. The drainage pipe 70 is connected to a water supply inlet 83 of the water tank 81.

A water level sensor 75, water level detection means to detect a water level of the water held in the pot 61, is disposed in the water level detection room 63. A water level sensor 76 is disposed in the relay tank 72 as water level detection means to detect a water level of the water held in the relay tank 72. The water level sensor 75 is composed of a pair of electrode bars hanging down from the ceiling of the water level detection room 63. The water level sensor 76 is composed of four electrode bars hanging down from the ceiling of the relay tank 72. In electrode bars, a reference-voltage GND electrode and an anode are included. Two of the four electrode bars that compose the water level sensor 76 are longer than the two others, and extend near the bottom portion of the relay tank 72. One of the two others is shorter than the two electrode bars, and the rest of the two others is still shorter than the one. The water level sensor 75 is located at a position a little higher than the steam generation heater 65.

The heating chamber 20 is equipped with an exhaust path 77 through which the beating medium escapes. The duct 36 is also equipped with an exhaust path 78. An electric damper 79 is disposed at an inlet portion of the exhaust path 78.

Figure 5:
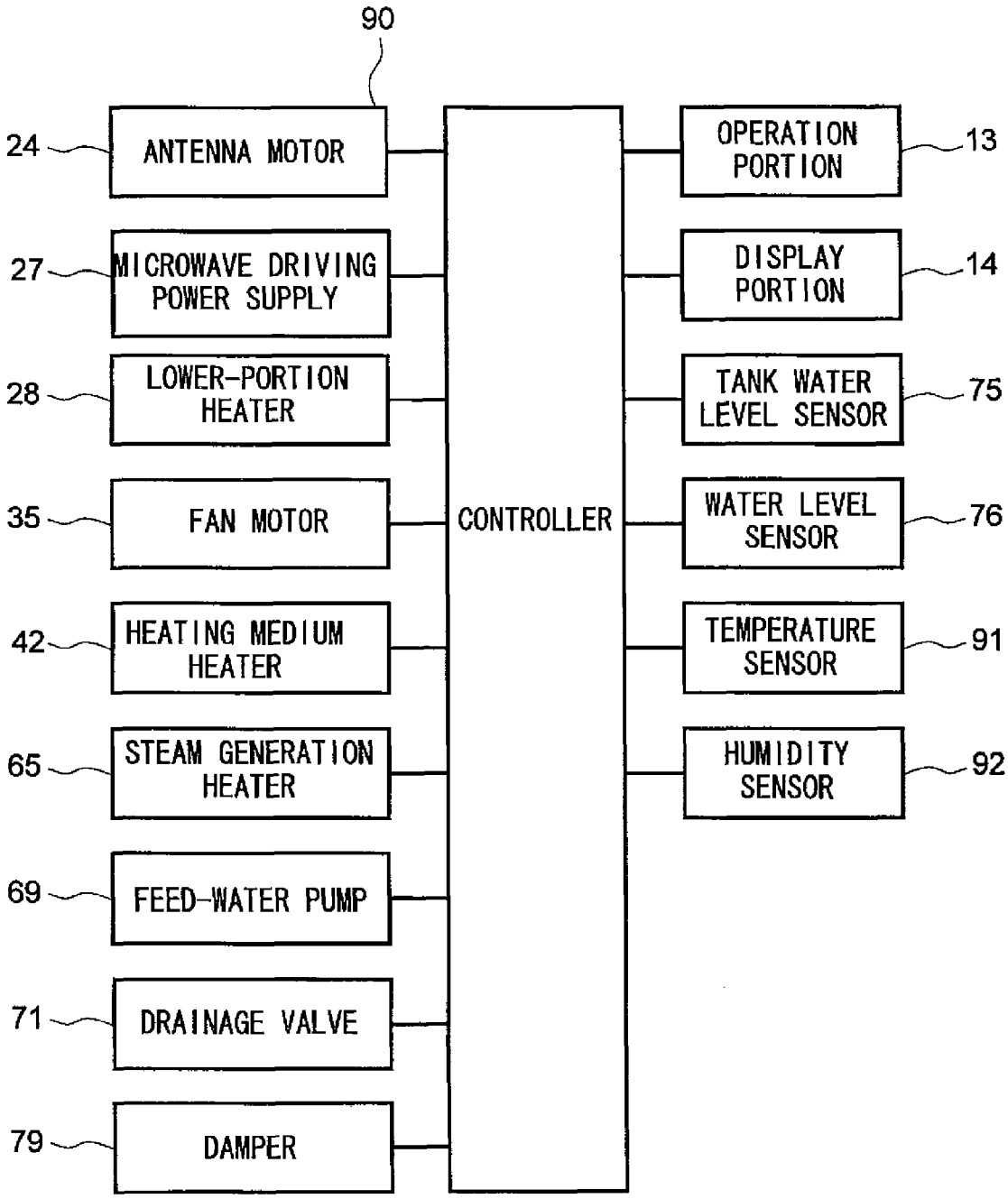
FIG. 5 is a control block diagram of a cooking device according to one embodiment of the present invention.

A controller 90 shown in FIG. 5 controls operation of the cooking device 1. The controller 90 includes a microprocessor and a memory, and controls the cooking device 1 executing a given program. Control progress is displayed on a display 14 in the operation console 13. The display 14 is composed of, for example, a liquid crystal panel. Operation commands are input into the controller 90 by manipulating various keys arranged on the operation console 13. Also, a sound generation apparatus that releases various sounds is disposed in the operation console 13.

Besides the operation console 13 and the display 14, the antenna motor 24, the microwave power supply 27, the lower heater 28, the fan motor 35, the heating-medium heater 42, the steam generation heater 65, the water feed pump 69, the drainage valve 71, the damper 79, the water level sensor 75, and the water level sensor 76 are connected to the controller 90. In addition, a temperature sensor 91 to measure temperature inside the heating chamber 20, and a humidity sensor 92 to measure humidity inside the heating chamber 20 are connected to the controller 90.

A food tray 100, which composes a food support unit U together with a food grill 110, supports a food F in the heating chamber 20. Tray supports are formed in the heating chamber 20 to support, at predetermined heights, the food tray 100 placed in the heating chamber 20. In the present embodiment, tray supports, which engage with the left and right edges of the food tray 100 to horizontally support the food tray 100, are formed on both side walls of the heating chamber 20.

Figure 2:
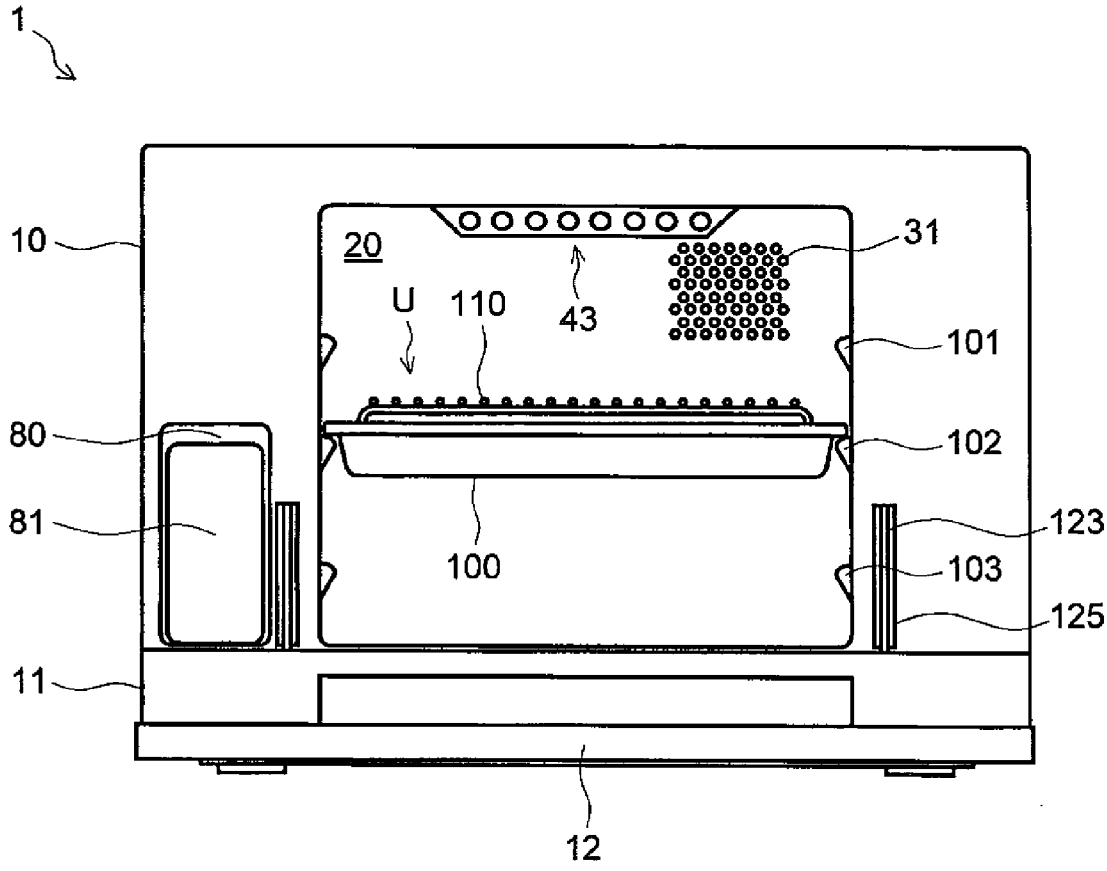
FIG. 2 is a front view of a cooking device according to one embodiment of the present invention with a door of a heating chamber opened.
Figure 3:
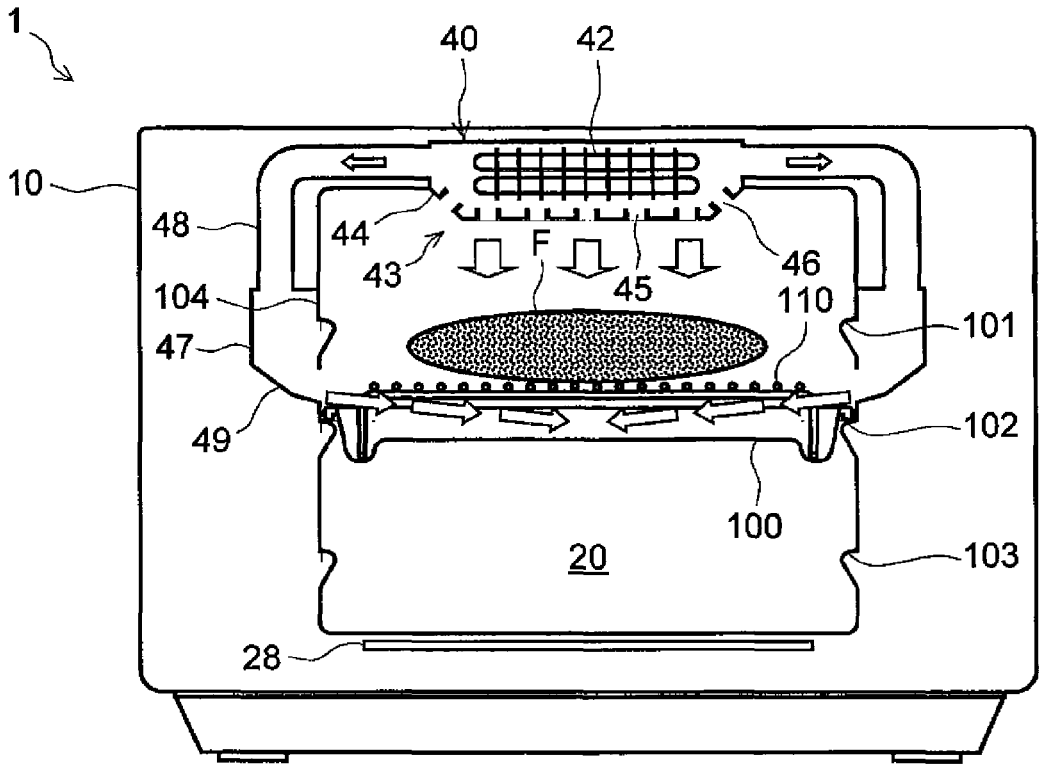
FIG. 3 is a schematic sectional view of a cooking device according to one embodiment of the present invention to explain a state in which a food tray is used.

As shown in FIG. 2, tray supports are formed in pairs and vertically arranged at three stages. A pair of first tray supports 101, disposed at a top stage, supports the food tray 100 at a position higher than a side heating-medium stream that flows into the heating chamber 20 from the side heating-medium supply gate 47. A pair of second tray supports 102, disposed at a middle stage, supports the food tray 100 at a position where the side heating-medium stream is blown. A pair of third tray supports 103, disposed at a bottom stage, supports the food tray 100 at a position that is a given distance away downward from the pair of second tray supports 102. The pairs of first, second and third tray supports 101, 102, and 103 are each formed of ridge-shaped protrusions protruding from the side-wall surfaces of the heating chamber 20.

During the time of cooking, if a food F drips fat or gravy, or if its lower surface must be exposed to the heating medium, the food grill 110 is placed on the food tray 100, and the food F is placed on the food grill 110.

Operation of the cooking device 1 is as follows. In a case superheated steam is used as the heating medium, the door 11 is opened, the water tank 81 is pulled out of the water tank housing 80, and water is poured into the water tank 81 through the water supply inlet 83. The water tank 81 with sufficient water is placed into the water tank housing 80 and set in position. After a secure connection between the outlet pipe 81 and the inlet pipe 73 of the relay tank 72 is confirmed, the food tray 100 bearing the food F on top of the food grill 110 is put into the heating chamber 20, and the door 11 is closed. Then, necessary ones in operation keys in the operation console 13 are pushed to select a cooking menu and to set various cooking conditions, and the cooking is started.

When the outlet pipe 82 is connected to the inlet pipe 72, the water tank 81 and the relay tank 72 communicate with each other so that the water level in the water tank 81 becomes equal to that in the relay tank 72. Accordingly, the water level in the water tank 81 also is measured by the water level sensor 76 which measures the water level in the relay tank 72. If the water in the water tank 81 has an enough amount of water to carry out the selected cooking menu, the controller 90 starts to generate steam. If the amount of water in the water tank 81 is insufficient to carry out the selected cooking menu, the controller 90 puts a caution on the display 14 telling that the selected cooking menu cannot be executed due to water shortage. And, steam generation will not be started unless the water shortage is settled.

If a condition in which steam can be generated is fulfilled, the water feed pump 69 starts operation to supply water to the steam generation apparatus 60. The drainage valve 71 is closed at this moment.

The water fills the pot 61 from its bottom. When a predetermined amount of water is supplied, the water supply is stopped. If the operation of the water feed pump 69 does not stop because of trouble of the control system, for example, the water level in the pot 61 continues to rise even if it surpasses a predetermined level. However, when the water level reaches an overflow level, excess water in the pot 61 returns to the relay tank 72 through the overflow pipe 68. Accordingly, the water does not overflow from the pot 61.

After the water supply is stopped, power supply to the steam generation heater 65 is started. The steam generation heater 65 directly heats the water in the steam generation room 64. Because of water currents through the communication portion between the water level detection room 63 and the steam generation room 64, and because of heat conduction through the dividing wall 62, the water temperature in the water level detection room 63 also rises. However, the temperature rising rate is low compared with that of the water in the steam generation room 64.

When the water in the steam generation room 64 boils and saturated steam is generated, the power supply to the steam generation heater 65 is stopped. Then, power supply to the blower 32 and to the heating-medium heater 42 is started. The blower 32 sucks air from the heating chamber 20 through the inlet 31. Also, the blower 32 sucks saturated steam from the steam generation apparatus 60 through the steam supply pipe 66. A mixture of the air blown out from the blower 32 and the saturated steam is introduced into the heating-medium generation apparatus 40 through the duct 36. The damper 79 closes the inlet of the exhaust path 78 at this moment.

The saturated steam introduced in the heating-medium generation apparatus 40 is heated to 300° by the heating-medium heater 42, and the saturated steam turns into superheated steam. Some of the superheated steam is supplied through the upper heating-medium supply opening 43 into the heating chamber 20 in the form of downward jet and obliquely downward jet. The rest of the superheated steam is supplied through the side heating-medium supply gates 47 through the ducts 48, and into the heating chamber 20 in a form of slightly downward heating-medium jet. The food F in the heating chamber 20 is heated by heat brought by these superheated steams.

In heating by the superheated steam, the food F is heated by not only convection heat transfer (the specific heat of steam: 0.48 cal/g-° C.) but also by condensation heat (latent heat) produced when the superheated steam condenses on the food F. Because the condensation heat is large (539 cal/g), a large amount of heat is transferred to the food F, thereby the food F is rapidly heated. Besides, the superheated steam condenses first at low-temperature parts of the food F, and as a result, unevenness in heating is rectified.

As soon as the superheated steam adheres to a surface of the food F where the temperature is low, the superheated steam condenses into water, transferring large quantity of condensation heat to the food F. Then, water on the surface of the food F starts evaporation to get through a restoration process, and the food F starts to dry. Accordingly, the food F is finished crisp on the surface and juicy inside. Besides, effects of oil removal, salt reduction, curb on vitamin C destruction, and curb on oxidation of oils and fats are all remarkable compared with those in cooking with hot air.

When cooking with the superheated steam, electricity is not continuously supplied to the heat-medium heater 42, and the power supply is sometimes switched to the lower heater 28. As for power consumptions of the heaters, the steam generation heater 65 consumes 1300 W, the heating medium heater 42 consumes 1300 W, and the lower heater 28 consumes 700 W, for example. Regarding the power capacity of average household, it is difficult to supply power to two or more such heaters simultaneously, the power supply is switched in time sharing manner by duty control to obtain an optimal effect. Heating with hot air is executed in the same manner.

When the quantity of steam in the heating chamber 20 becomes large, excess steam is exhausted to the outside of the cooking device 1 through the exhaust path 77. To prevent the exhausted steam from condensing on the cooking device 1 or nearby article, and to prevent resulted water causing corrosion or smearing by mold, some kind of implement may be devised. For example, before being exhausted to the outside of the cooking device 1, the steam is condensed into water and drained.

The steam generation in the steam generating apparatus 60 will result in lowered water level in the pot 61. If the water level sensor 75 detects that the water level comes down to a predetermined level, the controller 90 resumes the operation of the water feed pump 69. The water feed pump 69 sucks up water from the relay tank 72, and supplies a predetermined amount of water into the pot 61. After completion of the water replenishment, the controller 90 stops again the operation of the water feed pump 69.

After completion of the cooking, the controller 90 puts a message on the display 14 telling that the cooking is completed, and releases a signal sound as well. Being informed of the cooking completion by the sound and display, the user opens the door 11, and pulls out the food tray 100 from the heating chamber 20. If no more cooking is scheduled, the drainage valve 71 is opened and the water in the pot 61 is returned to the water tank 81.

In case a cooking menu that uses hot air as the heating medium is selected, power supply to the heating-medium heater 42 and operation of the blower 32 are started immediately without checking water quantity in the water tank 81. This time, the food F is heated by a jet of hot air. Like in the heating with superheated steam, power supply to the heating-medium heater 42 and to the lower heater 28 is controlled in time sharing.

If the door 11 is opened during cooking with superheated steam or hot air, superheated steam or hot air can flow to the user. This is true after completion of the cooking as well. Accordingly, if the door 11 is opened when hot heating medium is circulating, the damper 79 opens the inlet of the exhaust path 78 so that the hot heating medium is guided into the exhaust path 78.

If a cooking menu using microwave is selected, the microwave generation apparatus 21 is powered. The microwave generation apparatus 21 can be used separately, or together with the apparatuses for generating superheated steam or hot air.

As described above, the food F is put into the heating chamber 20 being placed on the food tray 100. Which pair of tray supports is used to support the tray 100 depends on cooking menu. If cooking with superheated steam is selected, the food tray 100 is supposed to be supported by the pair of second tray supports 102, and a message telling that the food tray 100 is supposed to be supported by the pair of second tray supports 102 is put as a command on the display 14. In case it is the cooking with hot air, the food tray 100 may be supported by any pair of the first tray support 101, the second tray support 102, and the third tray support 103. When cooking with hot air, to carry out a two-stage cooking, it is possible to support a food tray 100 on the first tray support 101 and another food tray 100 on the third tray support 103. If the two-stage cooking is selected, a message telling that the first tray support 101 and the third tray support 103 is supposed to be used is put on the display 14.

When the second tray support 102 is used to support the food tray 100, the food grill 110 is placed on the food tray 100 so that the food F is raised higher than the surface of the food tray 100. The food grill 110 is beneficial even when the food tray 100 is supported by the first tray support 101 or by the third tray support 103. When the food tray 100 is supported by the second tray support 102, using the food grill 110 is almost inevitable to ensure the side heating-medium jets coming out from the side heating-medium supply openings 47 go under the food F.

The superheated steam is blown downward from the upper heating-medium supply opening 43 to the food F placed on the food tray 100 supported by the second tray support 102. The superheated steam, as the side heating-medium jets from the side heating-medium supply gates 47, hit the surface of the food tray 100 and changes their directions upward; thereby the superheated steam is blown to the lower surface of the food F as well. Thus, the superheated steam is blown to the food F from above and below, the food F is evenly exposed to convection heat and condensation heat (latent heat) and is efficiently heated. Fat and gravy dripped from the food F are received in the food tray 100 and are dumped after cooking.

Also hot air may be used to cook the food F placed on the food tray 100 supported by the second tray support 102. If the food F is raised with the food grill 110, the food F is evenly heated by hot air from above and below. As in cooking with superheated steam, fat and gravy dripped from the food F are received in the food tray 100 and are dumped after cooking.

As mentioned before, the open/close adjustment device, which pulls the door 11 back to the totally closed position, is connected to the door 11. The open/close adjustment device adjusts operation force to open or close the door 11 according to an angle of the door 11. Operation force depends on a load generated in the open/close adjustment device. In this specification, "operation force" is defined as a "force needed to change an angle of the door." "Load" is defined as a force with which one of two components being in contact with each other acts on the other.

Figure 6:
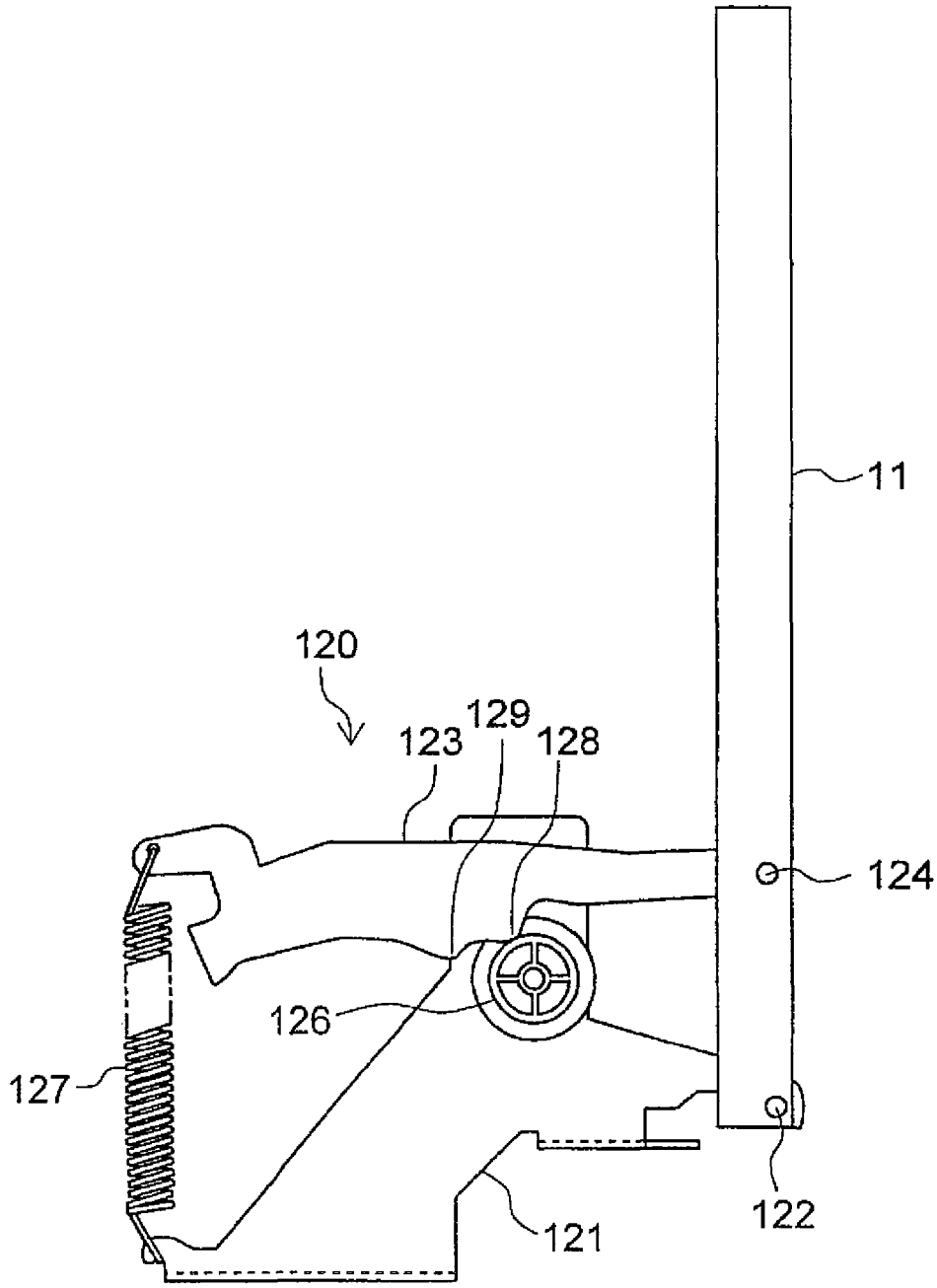
FIG. 6 is a side view of main components of an open/close adjustment device used in a cooking device according to one embodiment of the present invention.
Figure 7:
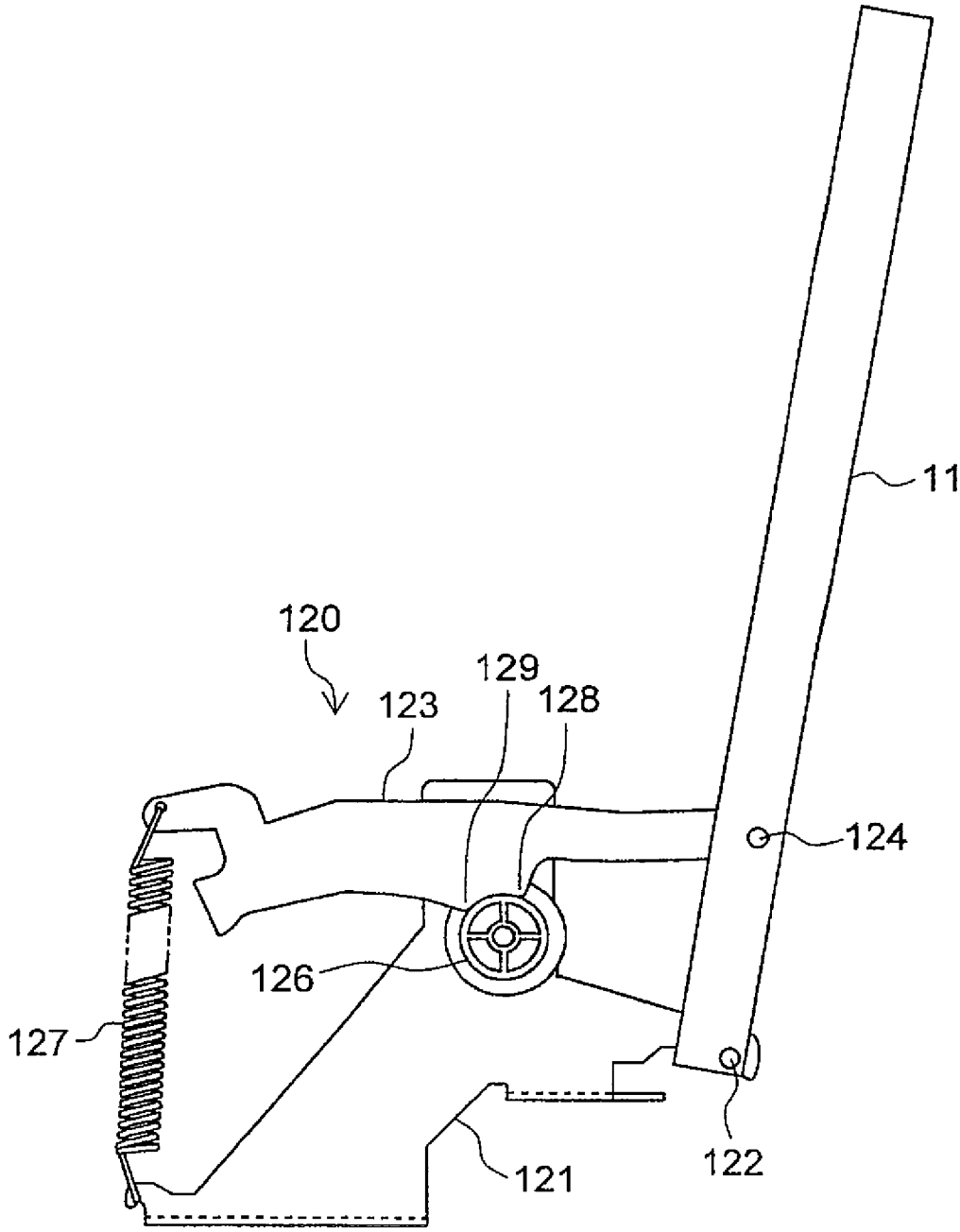
FIG. 7 is a side view of main components of an open/close adjustment device used in a cooking device according to one embodiment of the present invention, in a state different from that in FIG. 6.
Figure 8:
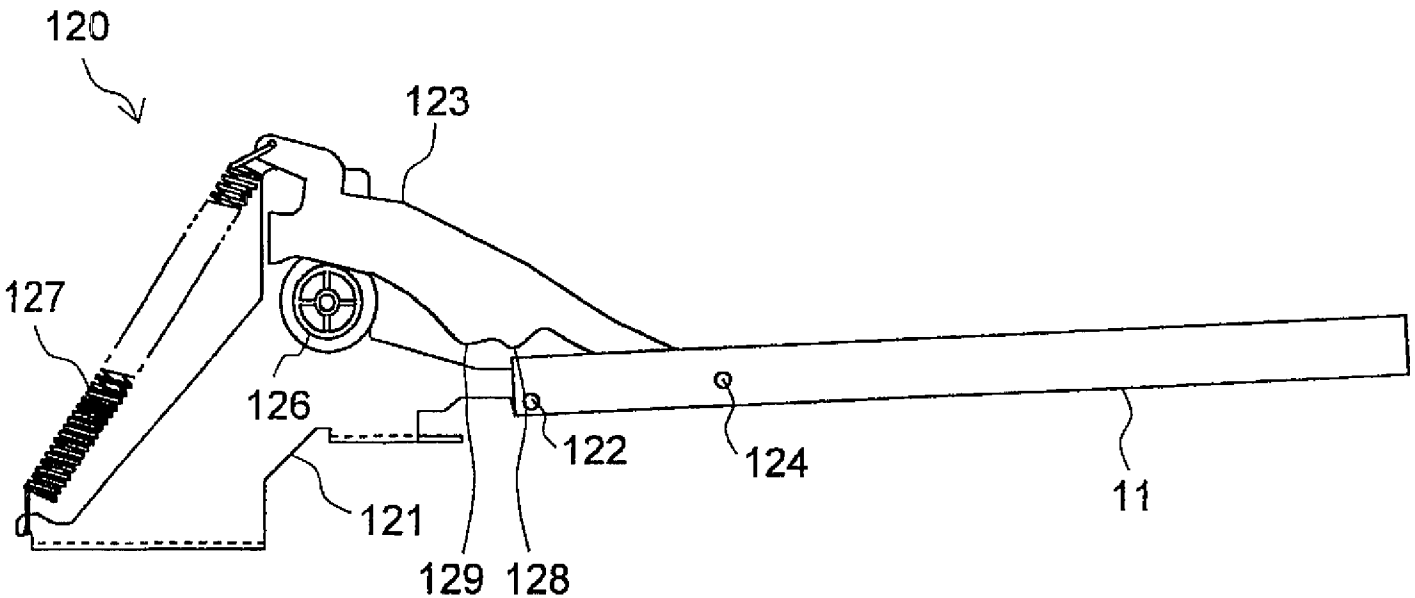
FIG. 8 is a side view of main components of an open/close adjustment device used in a cooking device according to one embodiment of the present invention, in a state different from that in FIG. 7.

Hereinafter, a structure and operation of the open/close adjustment device will be explained with reference to FIG. 6 to FIG. 8. Each one of FIG. 6 to FIG. 8 is a side view of main components, and shows a state different from each other.

An open/close adjustment device 120 is assembled centering on a base 121 fixed inside the cabinet 10. The base 121 is a pressed metal component. Two bases 121 are provided, one at a position corresponding to the left side of the door 11 and one at a position corresponding to the right side of the door 11. The left and right bases 121 have a shape symmetrical with each other.

A part of the base 121 protrudes outside the cabinet 10. This protruded part supports a lower end portion of the door 11 together with a pivot shaft 122 to form the open/close fulcrum of the door 11. In other words, the open/close adjustment device 120 serves as support means for the door 11. One end of a link 123 formed of a metal plate is connected to the door 11 with a stud shaft 124. The connection between the door 11 and the link 123 is located at a position higher than the open/close fulcrum. The link 123 goes in and out of a slot 125 (see FIG. 2) formed in a front surface of the cabinet 10.

The other end of the link 123 is a free end. A portion of the link 123 between the stud shaft 124 and the free end is supported from beneath by a support member located at a fixed position. In the present embodiment, the support member is composed of a pulley 126 mounted on the base 121. The pulley rotates around a horizontal axis. The link 123 is put between sheaves of the pulley 126.

A tension coil spring 127 is mounted across the free end of the link 123 and the base 121, which is a fixed member. The tension coil spring 127 exerts on the link 123 a force that presses the link 123 against the pulley, namely a load, and a force that causes the link 123 to pull the door 11 back to the totally closed position.

Two substantially triangular protrusions 128, 129 are formed on a lower surface of the link 123, the protrusion 128 at a front-side and the protrusion 129 at a rear-side, at relatively close locations. The protrusions 128, 129 produce resistance when they go over the pulley 126, that is, the door 11 is passing a predetermined open angle, and the resistance brings a maximum value to a load produced in the open/close adjustment device 120, specifically a load that the link 123 gives to the pulley 126. If the load reaches a maximum value, the operation force indicates a maximum value as well.

It is so designed that the load becomes relatively large in the opening direction of the door 11 and relatively small in the closing direction of the door 11 by adjusting inclinations of both sides of the protrusion. Accordingly, the operation force indicates a maximum value when the door 11 is passing a predetermined open angle. The maximum value at the time of opening the door 11 is larger than that at the time of closing the door 11.

As for the protrusions, the following protrusion 129 generates a load larger than a load that protrusion 128 generates first when the door 11 is opened. The distance between the protrusions 128 and 129 is so designed that both protrusions come into contact with the pulley 126 substantially simultaneously to stop movement of the link 123 with part of a periphery of the pulley 126 held between both protrusions.

FIG. 6 shows a state in which the door 11 is located at the totally closed position. At this moment, the protrusion 128 of the link 123 comes to contact with a left-side portion of the pulley 126 with respect the center of the pulley 126. In this state, because the tension coil spring 127 pulls down the free end of the link 123, the link 123 is urged to move leftward in FIG. 6, thereby the door 11 is totally closed.

When the door 11 is opened from the state shown in FIG. 6, a maximum-value load is produced in the open/close adjustment device 120 when the door 11 reaches a predetermined open angle, that is, when the protrusions 128, 129 go over the pulley 126. When the load reaches the local maximum value, the operation force that the user exercises to the door 11 reaches a maximum value as well. The angle at which the maximum operation force is required is set within 30° to the totally closed position of the door 1.

After the protrusion 128 goes over the summit of the pulley 126 producing a predetermined load, as shown in FIG. 7, the following protrusion 129 also comes into contact with the pulley 126 and is prompted to go over the summit of the pulley 126. Because the load produced by the protrusion 129 is larger than the load produced by the protrusion 128, the door 11 will not be opened any more if the operation force is the same as the preceding operation force. Returning the door 11 to the original state requires the protrusion 128 go over the summit of the pulley 126 again. In other words, in this state, whether the door 11 is moved in the opening direction or in the closing direction, the load produced in the open/close adjustment device 120 increases, and the movement of the link 123 is halted with part of the periphery of the pulley 126 held between the protrusions 128 and 129, unless the operation force is increased. Thus, the load acts on the open/close adjustment device 120 to maintain the open angle of the door 11 so that the door 11 keeps the half-open state even if the user releases the handle 12. Because the half-open angle of the door 11 is within 30° to the totally closed position, the heating medium in the heating chamber 20 escapes upward.

From the state shown in FIG. 7, if the handle 12 is further pulled toward the user to make the protrusion 129 go over the pulley 126, the door 11 advances to the totally opened state as shown in FIG. 8. The load produced when the protrusion 129 goes over the pulley 126 is smaller than the load produced when the protrusion 128 goes over the pulley 126. Accordingly, a large operation force is not necessary to move the door 11 from the half-open state to the full-open state.

In FIG. 8, gravity exerts a clockwise moment about the pivot shaft 122 on the door 11. On the other hand, a tensile force of the tension coil spring 127 exerts a counter-clockwise moment about the contact point between the link 123 and the pulley 126 on the link 123. Because the former moment (clockwise moment) is larger than the latter (counter-clockwise moment), the door keeps the fully opened state even if the user releases the handle 12.

When the door 11 is closed from the state shown in FIG. 8, the protrusion 129 first goes over the pulley 126. Because resistance acting on both protrusions 128 and 129 in the closing direction of the door 11 is smaller than resistance acting on both protrusions 128 and 129 in the opening direction of the door 11, the protrusion 128 goes over the pulley 126 successively after the protrusion 129 goes over the pulley 126. In other words, it is possible for the user to close the door 11 with a small operation force without being impeded by so large resistance as at the time of opening the door 11.

The tension coil spring 127 exerts the door 11*a* bias urging it toward the totally closed position, the user is assisted in the closing action and can easily close the door 11.

The link 123 moves on the pulley 126 whenever the door 11 is opened or closed. In this occasion, due to the rotation of the pulley 126, the movement of the link 123 faces relatively small resistance, thereby, the user gets smooth feel when opening or closing the door 11. Besides, the link 123 and the pulley 126 come not into sliding contact but into rolling contact with each other, the contact portions are not easily worn and no replacement of parts is needed for a long period.

In the present embodiment, a tension coil spring is used as a spring in the open/close adjustment device 120. However, it is also possible to use another kind of spring such as a compression coil spring, a torsion spring and the like. A spring that presses the link 123 against the pulley 126 and a spring that causes the link 123 to pull the door 11 back to the totally closed position may be provided independently. Furthermore, another structure also is possible, in which a spring is disposed between part other than the free end of the link 123 and a fixed member.

A support member that supports the link 123 from beneath is not limited to a pulley. Instead of the pulley 126, a non-rotational support member having a low-friction slide surface can be used.

Although the embodiments of the present invention are described above, the scope of the present invention is not limited to the embodiments, and various modifications can be made and put into practical use without departing from the spirit of the present invention.

INDUSTRIAL APPLICABILITY

The present invention is generally applicable to oven type cooking devices that use a heating medium for cooking.

The invention claimed is:

1. A cooking device which heats a food in a heating chamber with a heating medium, an opening of the heating chamber is closed with a door which swings around a horizontal pivot shaft disposed in a lower portion of the cabinet, the cooking device is characterized in that an open/close adjustment device which connects the cabinet and the door with each other and adjusts an operation force needed to open or to close the door, the operation force indicates a maximum value when the door is passing a predetermined angle, the maximum value is given by two protrusions disposed at front-side and rear-side with a distance between them, the protrusions each produce a load when they go over a support member, and a following one of the two protrusions produces a load larger than a load firstly produced by a preceding one of the two protrusions when the door is opened, and inclinations of both sides of the two protrusions are adjusted such that a larger load is produced when the door is opened than when the door is closed and a following one of the two protrusions produces a load smaller than a load firstly produced by a preceding one of the two protrusions when the door is closed, thereby producing a larger operation force needed to open the door than is needed to close the door.

2. The cooking device according to claim 1, wherein the open/close adjustment device exerts on the door a bias urging it toward the totally closed position.

3. The cooking device according to claim 2, wherein the open/close adjustment device includes: a link one end of which is connected to the door at a position higher than the open/close fulcrum of the door, and the other end of which is a free end; a support member which supports the link from beneath at a fixed position; a spring which is disposed between the link and a fixed member and exerts on the link a force that presses the link against the support member and a force that causes the link to pull the door back to the totally closed position; and the protrusions are formed on a lower surface of the link.

4. The cooking device according to claim 3, wherein the spring is a single tension coil spring that is mounted across the free end of the link and the fixed member.

5. The cooking device according to claim 1, wherein the support member is a wheel-shaped rotor.

* * * * *